US009845603B2

(12) United States Patent
Williams et al.

(10) Patent No.: US 9,845,603 B2
(45) **Date of Patent: *Dec. 19, 2017**

(54) PREFABRICATED SLATE AND TILE ROOFING

(71) Applicants: John M. Williams, Wells, VT (US); Robert B. Williams, Poultney, VT (US)

(72) Inventors: John M. Williams, Wells, VT (US); Robert B. Williams, Poultney, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/229,521

(22) Filed: Aug. 5, 2016

(65) Prior Publication Data

US 2017/0058527 A1 Mar. 2, 2017

Related U.S. Application Data

(60) Provisional application No. 62/211,357, filed on Aug. 28, 2015.

(51) Int. Cl.

| | |
|---|---|
| ***E04D 1/22*** | (2006.01) |
| ***E04D 1/12*** | (2006.01) |
| ***E04D 1/34*** | (2006.01) |
| ***E04D 1/36*** | (2006.01) |

(52) U.S. Cl.

CPC ..... *E04D 1/22* (2013.01); *E04D 1/12* (2013.01); *E04D 1/34* (2013.01); *E04D 1/36* (2013.01)

(58) Field of Classification Search

CPC .... E04D 1/34; E04D 1/12; E04D 1/14; E04D 1/36; E04D 2001/3432; E04D 2001/3458

See application file for complete search history.

(56) References Cited

U.S. PATENT DOCUMENTS

| | | | | |
|---|---|---|---|---|
| 2,097,845 | A * | 11/1937 | Lancy | E04D 12/00 52/543 |
| 2,361,450 | A * | 10/1944 | Black | E04D 1/36 428/186 |
| 5,457,924 | A * | 10/1995 | Fujii | E04D 1/365 52/396.1 |
| 5,642,596 | A * | 7/1997 | Waddington | E04D 1/34 52/546 |
| 5,794,396 | A * | 8/1998 | Gibbs | E04D 1/16 52/518 |
| 6,516,572 | B1 * | 2/2003 | Nowacek | E04D 1/14 428/150 |
| 7,478,507 | B2 * | 1/2009 | Krause | E04F 13/0832 52/546 |
| 8,661,760 | B2 * | 3/2014 | Williams | E04D 1/34 52/547 |
| 9,097,021 | B1 * | 8/2015 | Williams | E04D 1/365 |
| 9,322,174 | B1 * | 4/2016 | Williams | E04D 1/34 |

(Continued)

*Primary Examiner* — Paola Agudelo

(74) *Attorney, Agent, or Firm* — Lawrence J. Shurupoff

(57) ABSTRACT

A slate and tile roofing system includes a base layer of compliant roofing material and a series of tile fasteners fixed along a top portion of the roofing material. A series of weather barrier strips is attached to the series of fasteners and fixed to the roofing material. A series of slate tiles is semi-permanently mounted over the weather barriers to form a prefabricated tile roofing subassembly. The subassembly expedites and facilitates the installation of slate and tile roofs without the need for highly specialized labor.

19 Claims, 2 Drawing Sheets

(56) References Cited

U.S. PATENT DOCUMENTS

| | | | | |
|---|---|---|---|---|
| 2012/0055111 | A1* | 3/2012 | Fernandez Fernandez | E04D 1/14 52/543 |
| 2014/0250815 | A1* | 9/2014 | Vander Laan | E04D 1/34 52/520 |

* cited by examiner

PREFABRICATED SLATE AND TILE ROOFING

BACKGROUND

Slate and tile roofs are extremely durable and considered by many as the most desirable roofing available. Unfortunately, with this status comes a premium price. One of the most costly factors in the installation of a slate and tile roof is the cost of labor.

That is, skilled installers are required to properly install slate and tile roofs. Applying too much hammer force while nailing a tile to a roof deck can crack or break a tile. Applying too little hammer force can result in an unsightly loose tile or a tile which is subsequently blown away in high winds. Because there is a general shortage of properly skilled slate tile installers, labor costs for these installers are often so high as to be prohibitive. As a result, architects often opt for less costly roofing.

SUMMARY

As used herein, the term "tile" is intended to include any and all tiles including those formed of natural materials such as slate and rock as well as fabricated tiles such as fired clay, terra cotta, cement and aggregate tiles. The roofing assembly described herein is particularly well adapted for use with slate tiles.

In order to simplify the installation of slate and tile roofs and reduce or eliminate the need for highly skilled roofing installers, a prefabricated slate and tile roofing subassembly has been developed to reduce or eliminate the need for nailing tiles to a roof.

The tile roofing system described below can be installed by relatively unskilled labor using common low cost installation tools. This expands the available labor pool for tile installation while potentially reducing the cost of installation labor. This system can also reduce the time to install a tile roof as the prefabricated tile subassemblies described below include several tiles properly aligned in a series and ready for installation as a group. These preassembled series of tiles eliminate the need for the installation of individual tiles.

To further reduce the labor cost of installation as well as to reduce the material cost of roofing slate and tiles required to cover a roof, the prefabricated slate and tile roofing subassembly disclosed herein can be used with a two layer or single overlap tile installation system. A two layered, single overlap tile roof reduces the number of tiles required to cover a roof deck and thereby reduces the amount of weight bearing down on the roof deck. This allows architects and builders to specify less costly roof support designs than those required for conventional three layer, double overlap tile roof systems.

That is, conventional slate and tile roofs have used a three layered system wherein each tile is overlaid by two staggered upper tiles. By replacing the bottom tile with a layer of weatherproofing material, one layer of tile can be eliminated from each row or course of installed tile. In this manner, each tile is overlaid by a single upper tile. As noted above, this reduces the bearing load on the underlying roof structure and can thereby reduce its cost.

Because the weatherproofing material covering a roof deck is typically exposed to the environment along the spaces or gaps between adjacent tiles, it is subject to degradation and damage. A robust dual-layered weather barrier guard is provided to protect the underlying weatherproofing material and extend the useful life of the slate roof.

In order to greatly simplify the replacement of worn, damaged, broken or missing tiles, instead of nailing tiles to a structure such as a roof deck, tiles are adhesively bonded to a robust dual-layered weather barrier with an adhesive. In one embodiment, the adhesive can have a rubbery consistency which helps to absorb shock forces applied to the tiles.

That is, the rubbery adhesive forms a shock absorbing interface between the tiles and the underlying roofing material and roof deck. This reduces the potential for cracked or broken tiles caused by excessive external loading such as commonly produced by workmen stepping on the tiles. It also reduces cuts and punctures in the underlying roofing material caused by cracked and broken tiles.

By using a relatively soft rubbery adhesive such as silicone rubber adhesive, the resulting adhesive bond can be easily broken, either with a manual pull or with a simple bladed scraping tool. No nails need to be removed or replaced during tile replacement. This greatly simplifies tile replacement and eliminates the need for a skilled tile installer to properly nail a replacement tile to a roof deck.

The adhesive bond can be formed between a tile and a dual-layered weather guard formed of an underlying metal layer and an overlying plastic layer. A relatively narrow upper plastic layer can be centered over a relatively wide metal layer so that the sides of the metal layer extend beyond the sides of the overlying plastic layer.

This configuration of weather barrier provides two benefits. First, a stronger bond can be formed between an adhesive, such as a rubbery adhesive, and a tile as compared to an adhesive bond between a tile and a slick plastic material. Second, the prefabrication of a roofing tile subassembly can be facilitated by providing a low friction surface over the underlying metal layer. That is, when installing a tile on the subassembly, a tile can be more easily slid in proper final position over a smooth plastic layer than over a metal layer. The smoother plastic with a lower coefficient of friction reduces snags when sliding a tile in place during fabrication.

BRIEF DESCRIPTION OF THE DRAWINGS

In the Drawings.

In the drawings, like reference numbers designate like or similar parts.

DETAILED DESCRIPTION OF REPRESENTATIVE EMBODIMENTS

Figure 1:
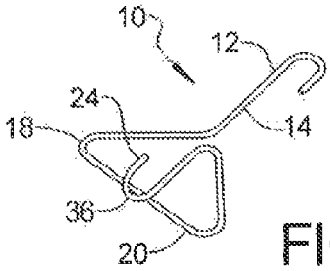
FIG. 1 is a perspective view of a representative tile fastener.

As shown in FIG. 1, a representative example of a slate, stone, or tile roofing fastener 10 formed of a strong wire material includes an upper mounting portion 12, a shank 14, two lateral wing portions 18, 20 and a hook portion 24. Additional details of a representative fastener are disclosed in U.S. Pat. No. 8,661,760, which is incorporated herein by reference in its entirety. As used herein, the terms slate and slate tile are used generically to include slate, ceramic and other generally flat roofing tiles.

Figure 2:
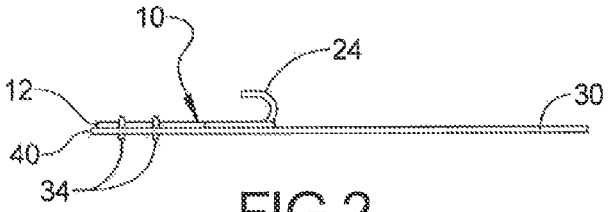
FIG. 2 is a side elevation view of the tile fastener of FIG. 1 fastened to a weatherproofing strip of roofing material.
Figure 3:
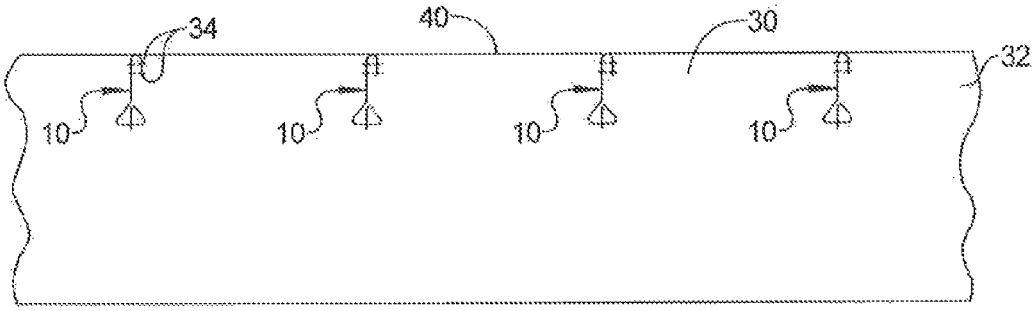
FIG. 3 is a top plan view of FIG. 2 showing a plurality of tile fasteners fastened to a weatherproofing strip.

The fastener 10 of FIG. 1 is shown in FIG. 2 mounted to a strip or base layer of roofing material 30. Roofing material 30 can take the form of a water resistant or waterproof sheet of plastic material such as high density polyethylene (HDPE) or a composite material such as commonly referred to as "tar paper". In the embodiment of FIGS. 2 and 3 the sheet of roofing material 30 is constructed from a sheet of HDPE 0.025 inch thick, eleven inches high and several feet long or wide. The HDPE can be effectively used as a carrier or base for carrying a prefabricated row of slate tiles, as described more fully below.

As further seen in FIGS. 2 and 3, a series of spaced apart fasteners 10 is initially mounted on the base layer of roofing material 30 with, for example, staples 34. Any other fasteners such as rivets or clips may be used. The fasteners 10 can be spaced at regular predetermined intervals. In this example, the fasteners 10 are evenly spaced apart by about 10.25 inches along the top portion 32 of the roofing material 30, with the bottom 36 (FIG. 1) of the hook portion 24 of the fastener 10 extending downwardly about three inches from the top edge 40 of the roofing material 30.

Figure 4:
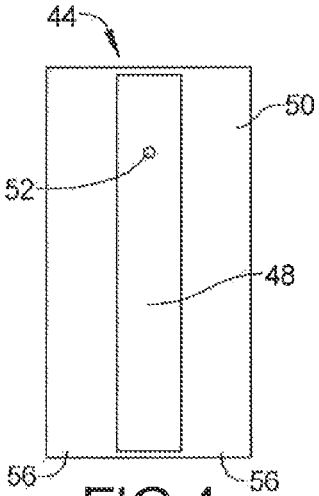
FIG. 4 is a top plan view of a laminated weather barrier.

As seen in FIG. 4, at least one laminated dual layer weather barrier 44 is constructed with a top strip 48 of weather resistant or waterproof roofing material such as used for the roofing material 30. In this example, the top strip 48 can be a one and one half (1½) inch wide strip of 0.025 inch thick HDPE, about nine inches high. As further seen in FIG. 4, the top strip 48 is positioned centrally over a thin lower strip 50 of weather resistant or waterproof material.

In this example, the lower strip 50 is constructed from a thin sheet of metal, such as a 0.025 inch thick strip of aluminum, about two and one half inches wide and about nine inches high. A thin sheet of metal material, such as aluminum, better withstands degradation from wear due to exposure to ambient weather than does a thin sheet of plastic material such as high density polyethylene ("HDPE").

By dimensioning the lower strip 50 wider than the upper or top strip 48, side portions 56 of the lower strip 50 extend laterally beyond opposite sides of the top strip 48. The side portions 56 provide exposed portions of the lower strip to which strong adhesive bonds are formed when bonding a tile to the side portions 56.

A better, more secure and longer lasting bond can be formed between an adhesive and a thin sheet of metal material, such as the lower metal strip 50, than between an adhesive and a thin sheet of smooth plastic material, such as the plastic top strip 48. This is because a metal material generally has greater resistance to deformation such as caused by flexing, bending and curling than does a plastic material of the same dimensions.

This deformation can degrade or break an adhesive bond. Moreover, because plastic roofing material such as HDPE typically has a glossy low friction surface that does not typically bond well with rubbery adhesives, a stronger bond can be formed on a less glossy or less slippery metal material having a higher coefficient of friction. This can provide a more secure bond for holding a tile on the weather barrier 44.

A hole 52 is punched through a central upper portion of both the top and bottom strips 48, 50 for receiving the hooks 24 of a fastener 10. The top and bottom strips can be fastened together prior to or after punching hole 52. The weather barrier 44 is mounted on a hook 10 by inserting the hook portion 24 and the bottom 36 of the hook 10 through the punched hole 52, as shown in FIG. 5.

Figure 5:
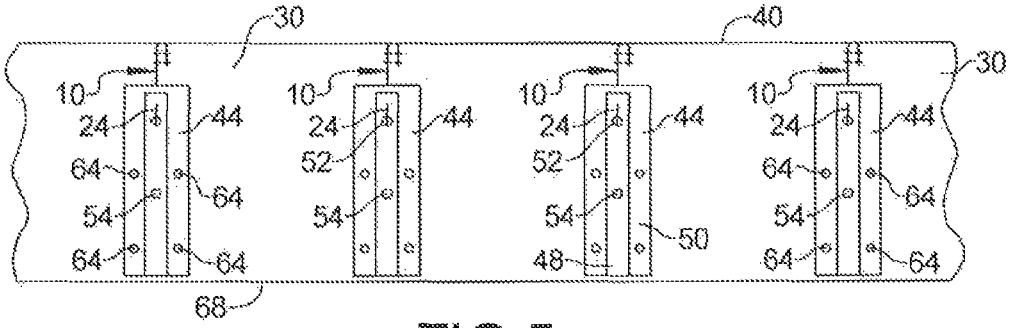
FIG. 5 is a top plan view of a series of the laminated weather barriers of FIG. 4 mounted to the weatherproofing strip of FIG. 3.

As further seen in FIG. 5, once the dual layer weather barrier 44 is loosely mounted over the roofing material 30 via fastener 10, the dual layer weather barrier 44 is permanently fixed to the roofing material 30 such as with the use of adhesives or fasteners such as staples. The spacing of the weather barriers is fixed and determined by the spacing of the fasteners 10. In the example of FIG. 5, one or more rivets 54 clamp each weather barrier 44 to the roofing material 30 at evenly spaced-apart intervals. This results in a first series of spaced-apart weather barriers.

Once the weather barriers 44 are mounted and spaced apart at predetermined equal spacings along the roofing material 30 in a generally mutually parallel configuration, a semi-permanent mounting is provided on at least one or more of the weather barriers 44 for receiving and holding a series of slate tiles 66 (FIG. 6) in predetermined positions along the roofing material 30. By semi-permanent it is meant that during manufacture, shipping, handling and final installation on a roof, the slate tiles 66 will be held securely in place over the weather barriers 44 and the underlying roofing material 30. However, if a slate tile 66 is damaged at any time either before or after installation on a roof, it can be removed manually without excessive force and without removing any nails.

In the example of FIG. 5, a rubbery adhesive, such as silicone glue, can be applied on the exposed sides 56 (FIG. 4) of each lower metal strip 50. Any suitable pattern of adhesive can be applied, such as spaced apart adhesive drops 64. A superior adhesive bond can be formed between the lower metal strip 50 and the slate tiles 66 compared to a similar adhesive bond formed between a top HDPE plastic strip 48 and the slate tiles 66.

Figure 6:
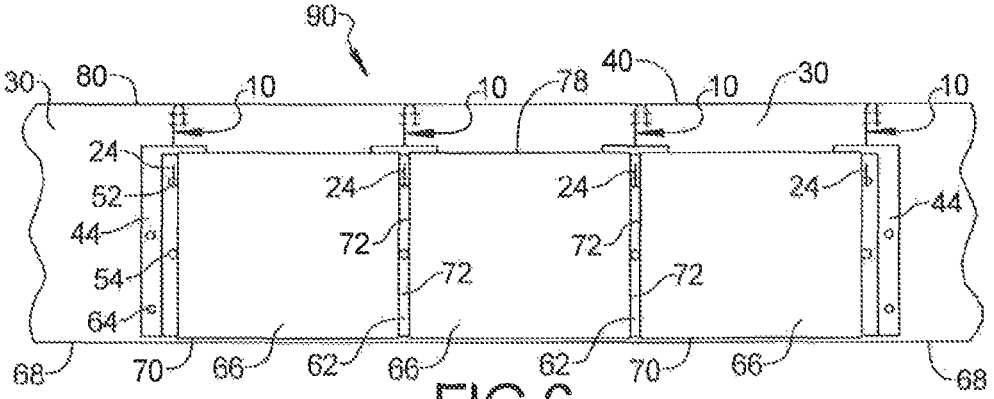
FIG. 6 is a top plan view of FIG. 5 with a series of slate tiles installed forming a prefabricated subassembly.

As further seen in FIG. 6, a series of slate tiles 66 is pressed over and onto each adhesive drop 64 to form a secure but removable or breakable bond with the weather barriers 44. Since the weather barriers 44 are fixed to the underlying roofing material 30, the slate tiles 66, which are fixed to the weather barriers, are thereby fixed in position over the roofing material as well. Each pair of adjacent tiles 66 overlies the wing portions 18, 20 of the underlying portion of a fastener 10.

While all the tiles 66 in this example are adhesively attached to their respective underlying weather barriers 44, in other examples, at least one or more tiles 66 can be adhesively attached to an underlying weather barrier 44. The weather barriers 44 protect the underlying roofing material 30 from exposure to the environment through the spaces 62 formed between the side edges 72 of adjacent slate tiles 66. This in turn protects the underlying roof deck from environmental damage and costly repairs.

Moreover, the weather barriers 44 distribute the weight of a workman over a greater area than the potentially sharp edges of the tiles 66 so as to reduce the stress applied to the underlying roofing material 30. This helps to prolong the useful life of the roofing material by preventing or reducing punctures through the roofing material.

In the example of FIG. 6, the slate tiles 66 are dimensioned about ten inches wide (side to side) and about nine inches high (bottom to top). The bottom edges 70 of the slate tiles 66 are aligned over or adjacent to the bottom edge 68 of the roofing material 30. The opposite side edges 72 of the slate tiles 66 are fitted closely between each adjacent pair of roofing fasteners 10. In this example, the top edges 78 of the slate tiles 66 extend about one inch above the bottom 36 of each hook 10 and about two inches below the top edge 40 of the roofing material 30. While the drawings are approximately drawn to scale, any other suitable dimensioning of components can be used in accordance with the general teachings set forth herein.

Figure 7:
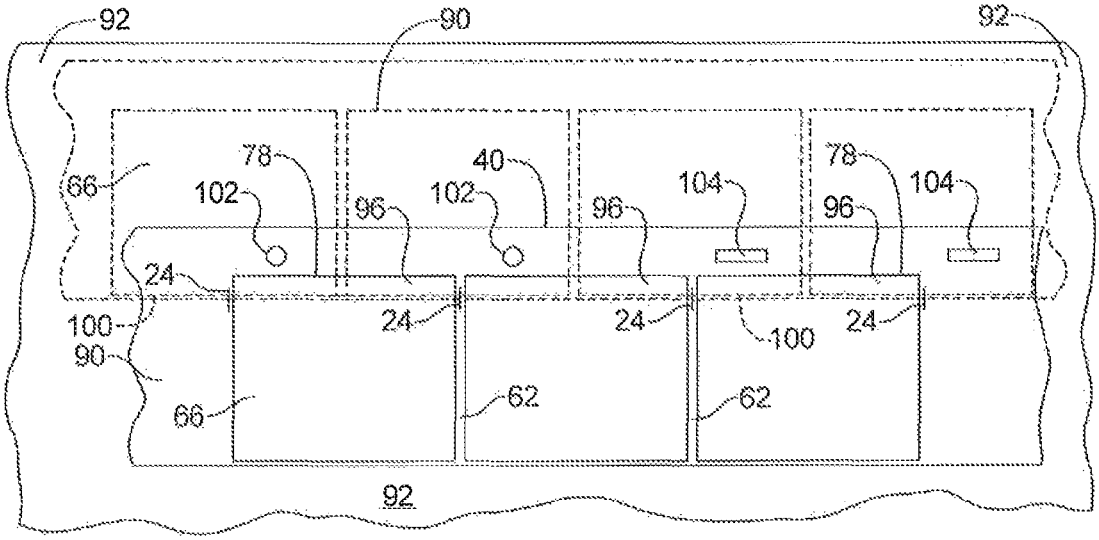
FIG. 7 is a schematic view of two rows or courses of the subassembly of FIG. 6 installed on a roof with an upper subassembly shown in dashed lines.

Once the adhesive drops 64 dry or cure, the resulting prefabricated roofing subassembly 90 as shown in FIG. 6 can be shipped to a construction site for installation. FIG. 7 shows a lower subassembly 90 installed on a roof deck 92 and an upper subassembly 90 in phantom installed on the roof deck 92 over the upper portions 96 of the slate tiles 66 in the lower subassembly. The slate tiles 66 on the upper subassembly 90 are laterally staggered over the slate tiles 66 on the lower subassembly 90 such that the midpoint or center of each tile 66 in the upper subassembly 90 is vertically centered or vertically aligned over a fastener 10 in the lower subassembly.

The lower edges 100 of the slate tiles 66 in the upper subassembly 90 are firmly seated in the mouths of the hooks 24 on the lower subassembly 90. The hooks 24 are dimensioned to project upwardly from the base layer 30 and between and above each adjacent tile 66 so as to receive the lower edges 100 of the tiles 66 on an upper subassembly 90. Each subassembly 90 can be permanently fixed to the roof 92 with roofing nails 102, staples 104 or any other type of fastener or adhesive. Each subassembly 90 can be cut to length as needed or extended by overlap with another subassembly as shown in FIG. 8.

Figure 8:
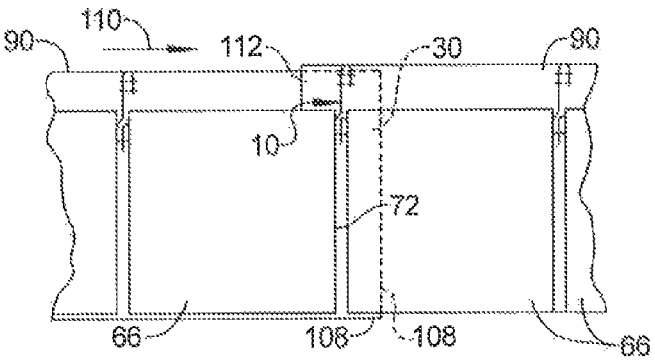
FIG. 8 is a top plan partial schematic view of a pair of subassemblies of FIG. 6 installed in an overlapped side by side configuration.

For example, as seen in FIG. 8, the free lateral end portion 108 of the roofing material 30 on one subassembly 90 can be slid in the direction of arrow 110 under the free end portion 112 of the roofing material 30 on an adjoining subassembly 90, until the side edge 72 of the moving slate tile 66 abuts the fastener 10 on the adjoining subassembly 90. In this example, the two subassemblies 90 are shown slightly vertically offset from each other for purposes of clarity and detail. However, in practice, the two subassemblies 90 are more closely aligned in a straight row with the top edges 40 and bottom edges 68 of the roofing material 30 aligned in straight lines.

Because this method of installation is similar to that used to install common asphalt shingles, those roofing installers familiar with the installation of asphalt shingles can quickly adapt to the installation of the tile roofing system using subassemblies 90. This increases the number of roofing installers potentially available for installing the tile roofing system disclosed above and can potentially reduce labor installation costs.

There has been disclosed the best embodiment of the prefabricated slate and tile roofing assembly as presently contemplated. Numerous modifications and variations of the roofing assembly are possible in light of the above teachings. It is therefore understood that within the scope of the appended claims, the slate tile roofing concepts may be practiced otherwise than as specifically described herein.

What is claimed is:

1. A prefabricated roofing assembly comprising:
- a base layer comprising roofing material;
- a series of spaced-apart tile fasteners fixed on said base layer;
- a first series of spaced-apart weather barrier strips coupled to said base layer;
- a second series of spaced-apart weather barrier strips respectively provided over said first series of spaced-apart weather barrier strips; and
- a series of tiles respectively layered over said first and second series of spaced apart weather barrier strips and adhesively bonded to said first series of spaced-apart weather barrier strips.

2. The assembly of claim 1, wherein said first series of spaced-apart weather barrier strips comprises metal strips and said second series of spaced-apart weather barrier strips comprises plastic strips.

3. The assembly of claim 2, wherein said metal strips comprise aluminum and wherein said plastic strips comprise high density polyethylene.

4. The assembly of claim 2, wherein at least one of said metal strips is wider than and underlies at least one of said plastic strips such that opposite edge portions of said at least one of said metal strips extend laterally outwardly from below opposite sides of said at least one of said plastic strips.

5. The assembly of claim 4, wherein at least one tile of said series of tiles is adhesively bonded to one of said edge portions of said at least one of said metal strips.

6. The assembly of claim 5, wherein said at least one tile of said series of tiles is adhesively bonded to one of said edge portions of said at least one of said metal strips with a rubbery shock-absorbing adhesive.

7. The assembly of claim 6, wherein said rubbery shock-absorbing adhesive comprises silicone rubber.

8. The assembly of claim 1, wherein at least one fastener in said series of spaced-apart tile fasteners comprises a hook portion located between and projecting above an adjacent pair of tiles in said series of tiles.

9. The assembly of claim 8, wherein one of said weather barrier strips in said first series of weather barrier strips and one of said weather barrier strips in said second series of weather barrier strips are each secured on said hook portion of one of said spaced-apart tile fasteners.

10. The assembly of claim 9, wherein said hook portion is inserted through each said one of said weather barrier strips in said first and second series of weather barrier strips.

11. The assembly of claim 1, wherein said base layer and said second series of weather barrier strips each comprise high density polyethylene and said first series of weather barrier strips comprises aluminum.

12. A prefabricated roofing assembly, comprising:
- a base layer of roofing material;
- a series of fasteners fixed in position at spaced intervals along said base layer, each of said fasteners comprising a hook portion projecting upwardly from said base layer;
- a metal weather barrier layered over said base layer;
- a plastic weather barrier layered over said metal weather barrier;
- a tile overlying a first portion of said metal weather barrier and overlying a first portion of said plastic weather barrier; and
- a rubbery adhesive bonding said tile to said first portion of said metal weather barrier and serving as a shock absorber between said metal weather barrier and said tile.

13. The assembly of claim 12, wherein said metal weather barrier and said plastic weather barrier are coupled to said base layer by one of said fasteners in said series of fasteners.

14. The assembly of claim 12, wherein said hook portion of one of said fasteners in said series of fasteners is inserted through said metal weather barrier and inserted through said plastic weather barrier.

15. The assembly of claim 12, wherein said hook portion of one of said series of fasteners projects upward above and adjacent to said tile.

16. The assembly of claim 12, wherein said metal weather barrier is wider than said plastic weather barrier such that edge portions of said metal weather barrier extend laterally outwardly from below said plastic weather barrier.

17. The assembly of claim 16, wherein said rubbery adhesive is bonded to one of said edge portions of said metal weather barrier.

18. The assembly of claim 12, wherein said metal weather barrier comprises aluminum, wherein said plastic weather barrier comprises high density polyethylene and said rubbery adhesive comprises silicone rubber.

19. The assembly of claim 12, wherein at least one of said fasteners in said series of fasteners comprises a pair of laterally-extending wing portions extending under said metal weather barrier and said plastic weather barrier.

* * * * *